US006612627B2

(12) United States Patent
Wheatland

(10) Patent No.: US 6,612,627 B2
(45) **Date of Patent: *Sep. 2, 2003**

(54) DOOR LATCH ASSEMBLY WITH ACCELERATED BOLT MOTION, DEADBOLT AND REPLACEMENT FACE PLATES

(75) Inventor: Graham John Wheatland, Tucson, AZ (US)

(73) Assignee: Weiser Lock Corporation, Tucson, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/121,084

(22) Filed: Apr. 11, 2002

(65) Prior Publication Data

US 2002/0109360 A1 Aug. 15, 2002

Related U.S. Application Data

(62) Division of application No. 09/501,616, filed on Feb. 10, 2000, now Pat. No. 6,419,288.

(51) Int. Cl.[7] ..... E05C 1/12

(52) U.S. Cl. ..... 292/169; 292/336.3; 292/337; 292/DIG. 53; 292/DIG. 60

(58) Field of Search ..... 292/1.5, DIG. 60, 292/336.3, DIG. 53, 337

(56) References Cited

U.S. PATENT DOCUMENTS

| | | | | | |
|---|---|---|---|---|---|
| 1,505,380 | A | * | 8/1924 | Dexter | 292/337 |
| 2,004,510 | A | * | 6/1935 | Schlage | 70/451 |
| 2,327,070 | A | * | 8/1943 | Schlage | 70/451 |
| 2,410,462 | A | * | 11/1946 | Schlage | 70/451 |
| 2,444,819 | A | * | 7/1948 | Freysinger | 292/169.22 |
| 2,983,540 | A | * | 5/1961 | Check | 292/337 |
| 3,055,691 | A | * | 9/1962 | Kessel | 292/337 |
| 4,381,656 | A | * | 5/1983 | Hayakawa | 70/451 |
| 4,662,665 | A | * | 5/1987 | Lin | 292/167 |
| 4,687,239 | A | * | 8/1987 | Lin | 292/172 |
| 4,729,585 | A | * | 3/1988 | Lin | 292/337 |
| 4,756,638 | A | * | 7/1988 | Neyret | 403/261 |
| 4,768,817 | A | * | 9/1988 | Fann et al. | 292/337 |
| 4,772,055 | A | * | 9/1988 | Fang | 292/337 |
| 4,840,413 | A | * | 6/1989 | Shen | 292/337 |
| 4,871,202 | A | * | 10/1989 | Friedrichs et al. | 292/169 |
| 4,902,057 | A | * | 2/1990 | Ching | 292/337 |
| 4,957,315 | A | * | 9/1990 | Lin | 292/337 |
| 4,974,883 | A | * | 12/1990 | Jans | 292/169 |
| 4,974,884 | A | * | 12/1990 | Dietrich | 292/173 |
| 4,976,122 | A | * | 12/1990 | Doolan et al. | 70/134 |
| 5,039,146 | A | * | 8/1991 | Lin | 292/337 |
| 5,094,488 | A | * | 3/1992 | Boadwine et al. | 292/337 |
| 5,257,837 | A | * | 11/1993 | Bishop | 292/1.5 |
| 5,308,131 | A | * | 5/1994 | Galindo et al. | 292/337 |
| 5,364,138 | A | * | 11/1994 | Dietrich et al. | 292/1.5 |
| 5,364,139 | A | * | 11/1994 | Bergen et al. | 292/169 |
| 5,456,503 | A | * | 10/1995 | Russell | 292/1.5 |
| 5,458,382 | A | * | 10/1995 | Boadwine et al. | 292/337 |
| 5,474,346 | A | * | 12/1995 | Fann et al. | 292/337 |
| 5,501,492 | A | * | 3/1996 | Kajuch | 292/1.5 |
| 5,516,163 | A | * | 5/1996 | Baker | 292/169 |
| 5,562,314 | A | * | 10/1996 | Wheatland et al. | 292/1.5 |
| 5,611,581 | A | * | 3/1997 | Ghostley | 292/165 |
| 5,683,127 | A | * | 11/1997 | Chamberlain | 292/337 |
| 5,690,372 | A | * | 11/1997 | Jans | 292/169 |
| 5,769,472 | A | * | 6/1998 | Small | 292/337 |
| 5,957,510 | A | * | 9/1999 | Kuo | 292/1.5 |

* cited by examiner

*Primary Examiner*—J. J. Swann
*Assistant Examiner*—Carlos Lugo
(74) *Attorney, Agent, or Firm*—Reising, Ethington, Barnes, Kisselle, PC

(57) ABSTRACT

A door latch has an adjustable cam (25) to accommodate two backsets of the bore (24) through a door. The cam (25) is operably attached to a handle 14. Rotation of the handle (24) approximately 45° fully retracts latch bolt (54) and deadbolt (56) through a slide actuator (100) that pulls a link (112) which pivots a cam lever (104) that retracts the bolt (54). The bolt (54) retracting motion is magnified with respect to the motion of actuator (100) via the link (112) and cam lever (104). The link (112) and cam lever (104) are mounted within cylinder section half (52) of housing (28) so as not to interfere with the deadbolt (56) and its slide (150) and deadbolt locking plate (170) that are mounted in a complementary cylinder half (51).

17 Claims, 7 Drawing Sheets

DOOR LATCH ASSEMBLY WITH ACCELERATED BOLT MOTION, DEADBOLT AND REPLACEMENT FACE PLATES

This application is a Divisonal of U.S. patent application Ser. No. 09/501,616, filed Feb. 10, 2000 now U.S. Pat. No. 6,419,288.

TECHNICAL FIELD

The field of this invention relates to a latch assembly for doors.

BACKGROUND OF THE DISCLOSURE

Door latch assemblies are used in diverse applications. Some of these applications call for doors with different backsets for the door latch to accommodate differently sized operating doorknobs or handles. The latch assemblies are desirably adaptable for use in both wood and metal doors. A modem latch generally has a tubular latch housing that is mounted in a lateral bore at the edge of the door. The latching bolt has a canted forward face that provides retraction of the bolt when the face abuts against a striker plate in the doorjamb upon closing the door. The bolt springs back into the hole of the striker plate to latch the door shut. It is desirable to incorporate a deadbolt or privacy bolt which when recessed by abutment against the striker plate prevents the latching bolt from retraction unless operated by the door knob.

In wood doors, the faceplate is conventionally rectangular in shape and fits within a mortised or chiseled recess in the door edge. The rectangular shape may have rounded corners for aesthetic purposes. In metal doors, a circular faceplate is conventionally used which has a plurality of serrations or ribs in its periphery and which is driven into and secured to the lateral bore in the door. Latches with these circular faceplates thus are commonly referred to as drive-in latches.

Most handles or doorknobs need to be turned approximately one-quarter of a revolution to fully retract the latch bolt to open the door, i.e. 80–90°. Some latch constructions are known which provide for full retraction of the latch bolt with a smaller rotation of the doorknob or handle. However these known constructions do not easily facilitate the incorporation of a deadbolt, the choice of faceplates, or the use of a backset adjustment that is often required.

What is needed is a latch assembly that can incorporate the advantages of an easy choice of faceplate attachments. What is also needed is a latch assembly that provides for accelerated retraction of the latch bolt during rotation of the doorknob or handle while optionally incorporating a deadbolt privacy mechanism.

SUMMARY OF THE DISCLOSURE

In accordance with one aspect of the invention, a door latch assembly includes a latch housing having a latch bolt slideably movable from a latch position to a release position. A faceplate has an opening sized to receive the latch bolt. The faceplate has a rearwardly extending flange contoured to seat the latch housing therein.

A securement link secures the faceplate to the latch housing. Preferably the link is pivotably connected to the exterior of the housing and has a distal tip bent toward the center axis of the housing to engage a slot of the faceplate when the faceplate is seated on the latch housing to releasably secure the faceplate to the latch housing. Alternatively, the link may be pivotably secured to the faceplate, preferably at the flange, and engage a slot in the latch housing.

Preferably the securement link is in the form of a yoke with two aligned pivotable connections on opposite circumferential sides of the latch housing or faceplate. The yoke has two opposing distal tips that selectively engage two opposing slots in the other of the faceplate or latch housing.

In one embodiment, slots on opposite sides of the latch housing are aligned with the slots in the faceplate and the distal tips of the yoke are long enough to extend entirely through the slots in the faceplate and into the slots of the latch housing. Preferably, all the slots are arcuate in shape to correspond to the path that the distal tip moves in when the yoke is pivotably moved about its pivotable connection to the latch housing.

In accordance with another aspect of the invention, a latch housing for a door latch has a latch bolt slideably movable from a latch position to a release position. A securement link is pivotably connected to the housing and has a distal tip bent toward the center axis of the housing to be engageable with a slot of a faceplate to releasably secure a faceplate thereto.

In accordance with another aspect of the invention, a latch device includes a housing with an interior and an opening at one end thereof. The housing houses a bolt assembly that is biased by a spring to the extended position through the opening and longitudinally slideable in the housing against the force of the spring to a retracted position. A cam lever has a distal end that is operably connected to the bolt to move the bolt to its retracted position. The cam lever is pivotably connected to the housing. The housing also mounts a sliding actuator for reciprocal motion between a first position, which corresponds, to the extended position of the bolt and a second position which, corresponds to the bolt's retracted position. A link member operably connects the sliding actuator to the cam lever at a position between the cam lever's pivotable connection to the housing and the cam lever's distal end for magnifying the bolt motion between its extended and retracted positions relative to the sliding actuator's motion between its first and second positions.

Preferably, the sliding actuator has a planar section that is laterally disposed adjacent a rearwardly extending plate section of the bolt. The link member is disposed adjacent the planar section of the sliding actuator. The cam lever is generally disposed in the same plane as the planar section of the sliding actuator.

In one embodiment, the link has first and second protrusions in proximity to respective ends of the link. The first protrusion is received in and engages an aperture in the sliding actuator. The second protrusion is received in and engages a slot in the cam member. The planar section of the bolt has a laterally extending prong that is bent transversely from the planar section and laterally extends into the plane of the cam lever for engagement to the distal end of the cam lever. Preferably, the link is slideably movable and guided in a longitudinal recess in a fixed casing in said housing.

It is desirable that a deadbolt is disposed on one side of the latch bolt and has a parallel path of reciprocation with the latch bolt. A deadlocking slide is engaged with the deadbolt and is constructed to move with the deadbolt laterally disposed adjacent a side of the planar section of the latch bolt that is opposite from the side of the sliding actuator, link and cam lever. A blocker member is selectively actuated by the deadlocking slide to block retracting motion of the bolt.

In this fashion a compact and expeditiously assembled door latch assembly provides for an adjustment of the back set, replacement of the faceplate, accelerated retraction of the latch bolt and use of a deadbolt.

BRIEF DESCRIPTION OF THE DRAWINGS

Reference now is made to the accompanying drawings in which.

DETAILED DESCRIPTION OF THE PREFERRED EMBODIMENT

Figure 1:
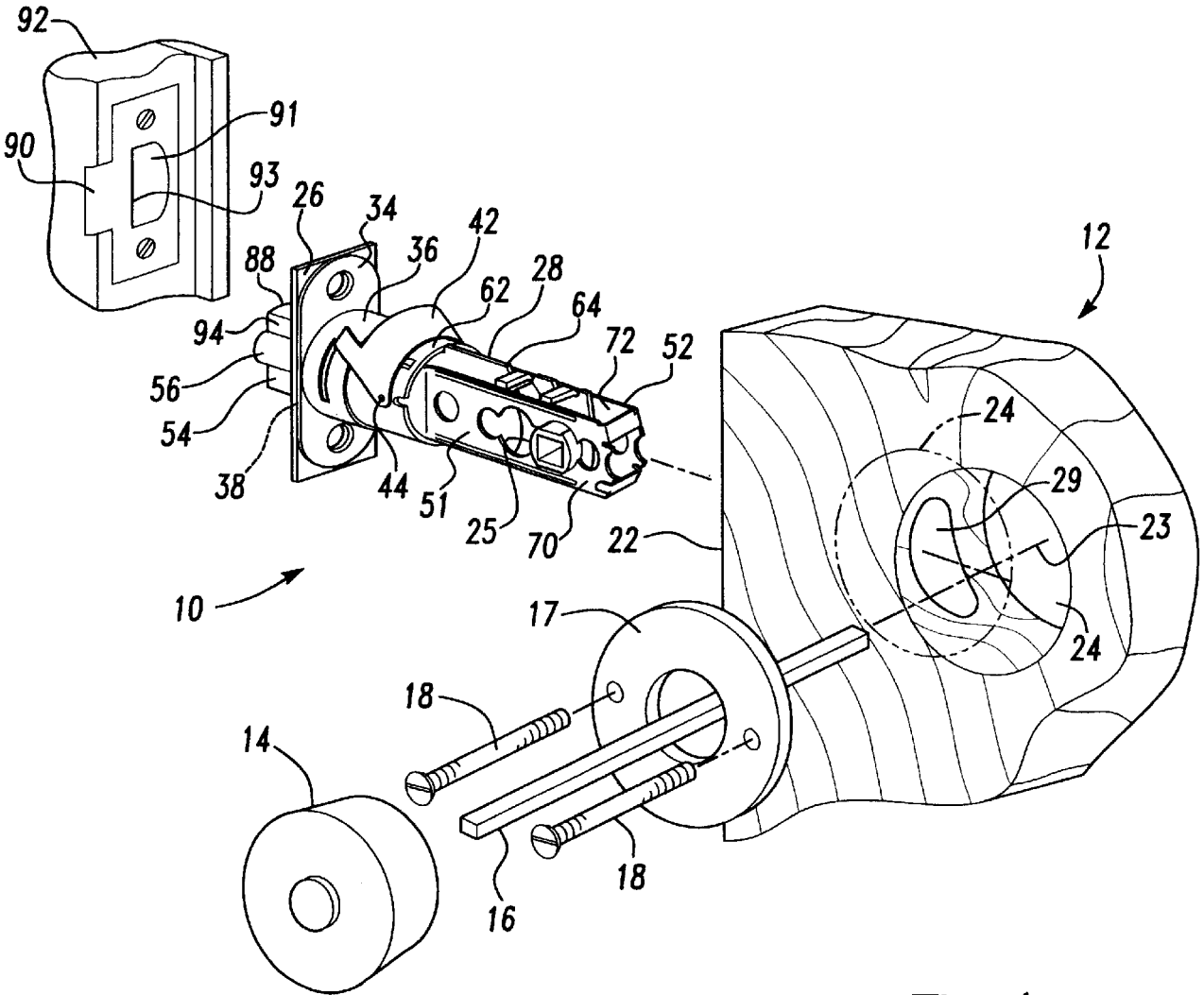
FIG. 1 is an exploded perspective view of a door latch assembly illustrating an embodiment of the invention in the environment of a door installation.

Referring now to FIG. 1, a latch assembly 10 is mountable within a door 12. The latching assembly 10 includes an operating handle 14 for latching and unlatching the assembly 10. The operating handle 14 may be in the form of a knob as shown or a lever handle. The handle includes a spindle 16, which forms the rotational axis 23 of operating handle 14. A similar handle may be provided on the opposite side of the door (not shown). The operating handle is mounted through conventional rose plates 17 and mounting bolts 18, which also extend through the latching assembly 10. The backset distance between the door edge 22 and the rotational axis of the operating handle 14 can be selectively adjusted between a 2-¼ inch backset and a 2-¾ inch backset. A bore 24 is drilled through the door 12 at the large backset position (in solid) or at the small backset position (shown in phantom). The latch assembly 10 and its operating cam 25 can accommodate the appropriately positioned bore 24 in the door in accordance with U.S. Pat. No. 5,257,837. All of the teachings and disclosure of U.S. Pat. No. 5,257,837 is herein incorporated by reference.

Figure 2:
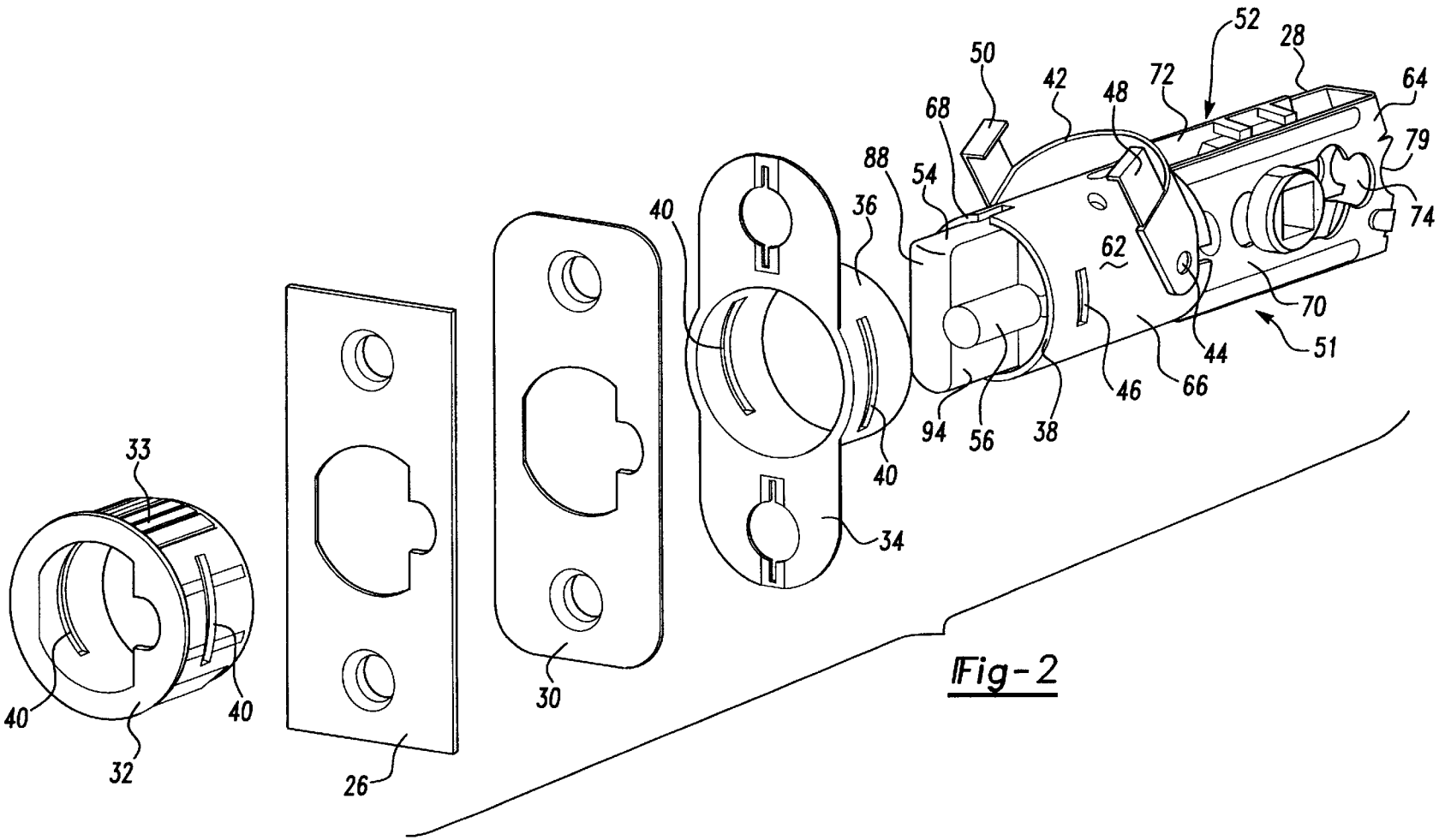
FIG. 2 is a perspective view of the latch assembly shown in FIG. 1 with a selection of faceplates.

The latch assembly 10 shown in FIG. 1 is installed in a wood door with a rectangular face plate 26 mounted about the latch housing 28. However, as shown in FIG. 2, the latch housing 28 may be selectively secured to other faceplates 30, or 32. The latch housing 28 extends through a lateral bore 29 in door edge 22 that extends to bore 24. Either faceplate 26 or 30 is permanently secured to a backing plate 34. Backing plate 34 has a rearwardly extending tubular flange 36 that is sized to snugly receive the latch housing 28 at it open end 38. The flange 36 has two opposing slots 40. Drive-in faceplate 32 also has similar slots 40 in its tubular section 33.

Figure 3:
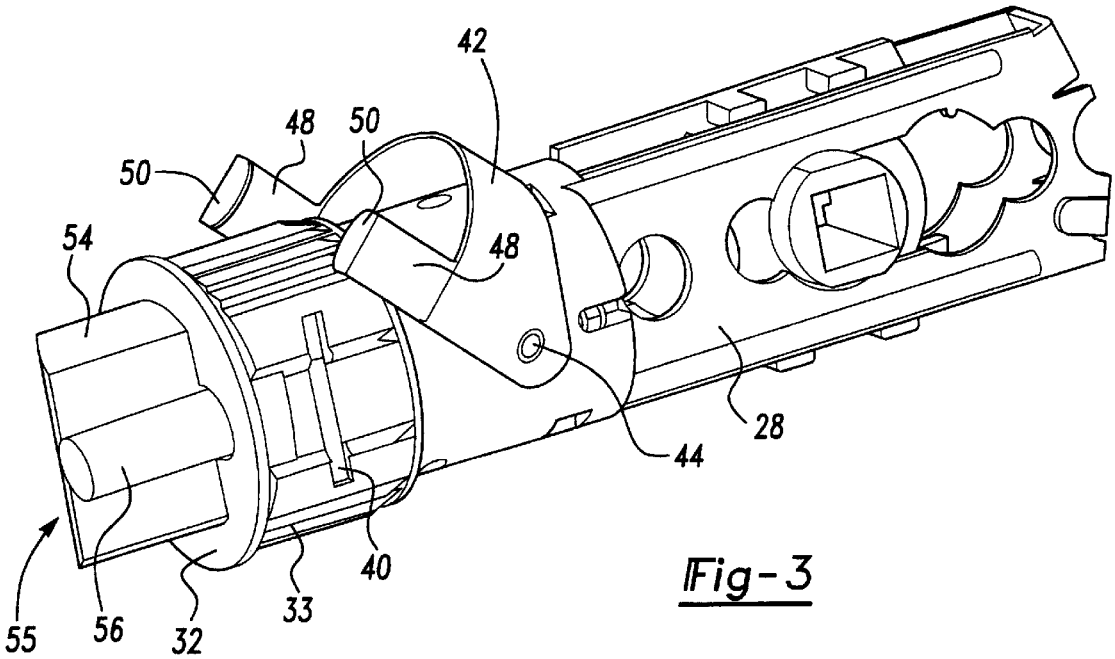
FIG. 3 is a perspective view of the latch assembly being installed with a drive-in faceplate.
Figure 4:
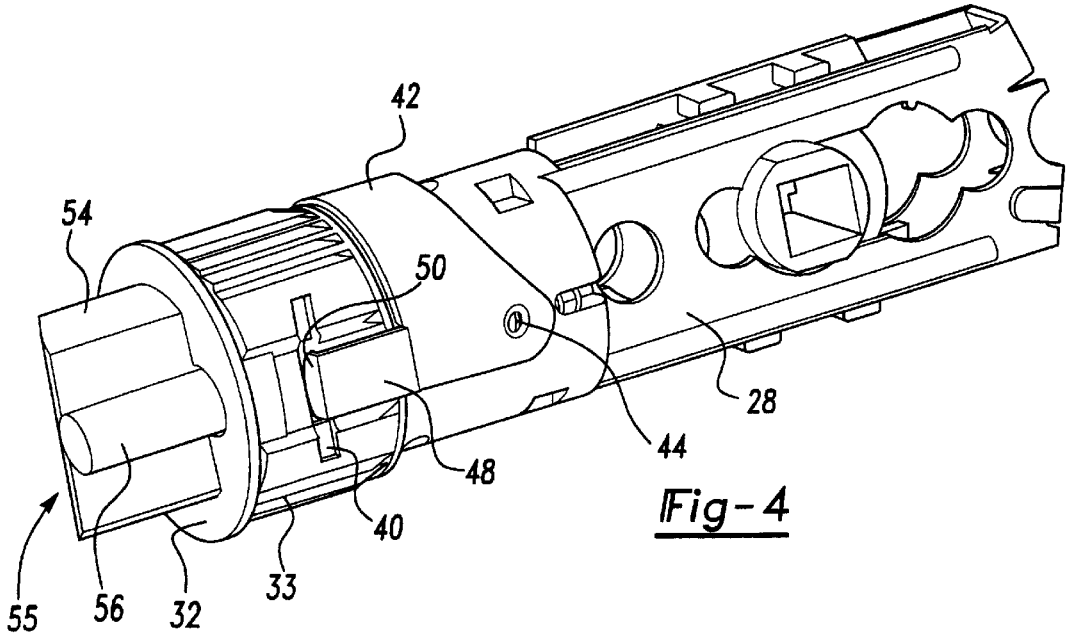
FIG. 4 is a view similar to FIG. 3 illustrating the drive-in faceplate being secured to the latch assembly housing.

The latch housing 28 has a pivotable yoke 42 that is pivotably connected to the housing at pivot axis 44 for pivotable motion from an open position as shown in FIGS. 2 and 3 to a closed position as shown in FIG. 4. The yoke 42 has two distal ends 48 with bent tips 50 that extend toward each other. The latch housing 28 also has two slots 46 that can be aligned with slots 40 when the appropriate plate is installed on housing 28.

As shown in FIG. 3, when the yoke is in the open position, the backing plate 34 or drive in faceplate 32 is slideable on and off the latch housing 28. While the backing plate 34 with face plate 26 is shown in FIG. 1, the housing can then be easily switched to have drive-in faceplate 32 as shown in FIG. 3. Once the selected face plate is in position, the yoke 42 can be pivoted to its closed position as shown in FIG. 4 such that the bent tips 50 engage the slots 40 and slots 46 to secure the face plate on the housing 28.

Figure 5:
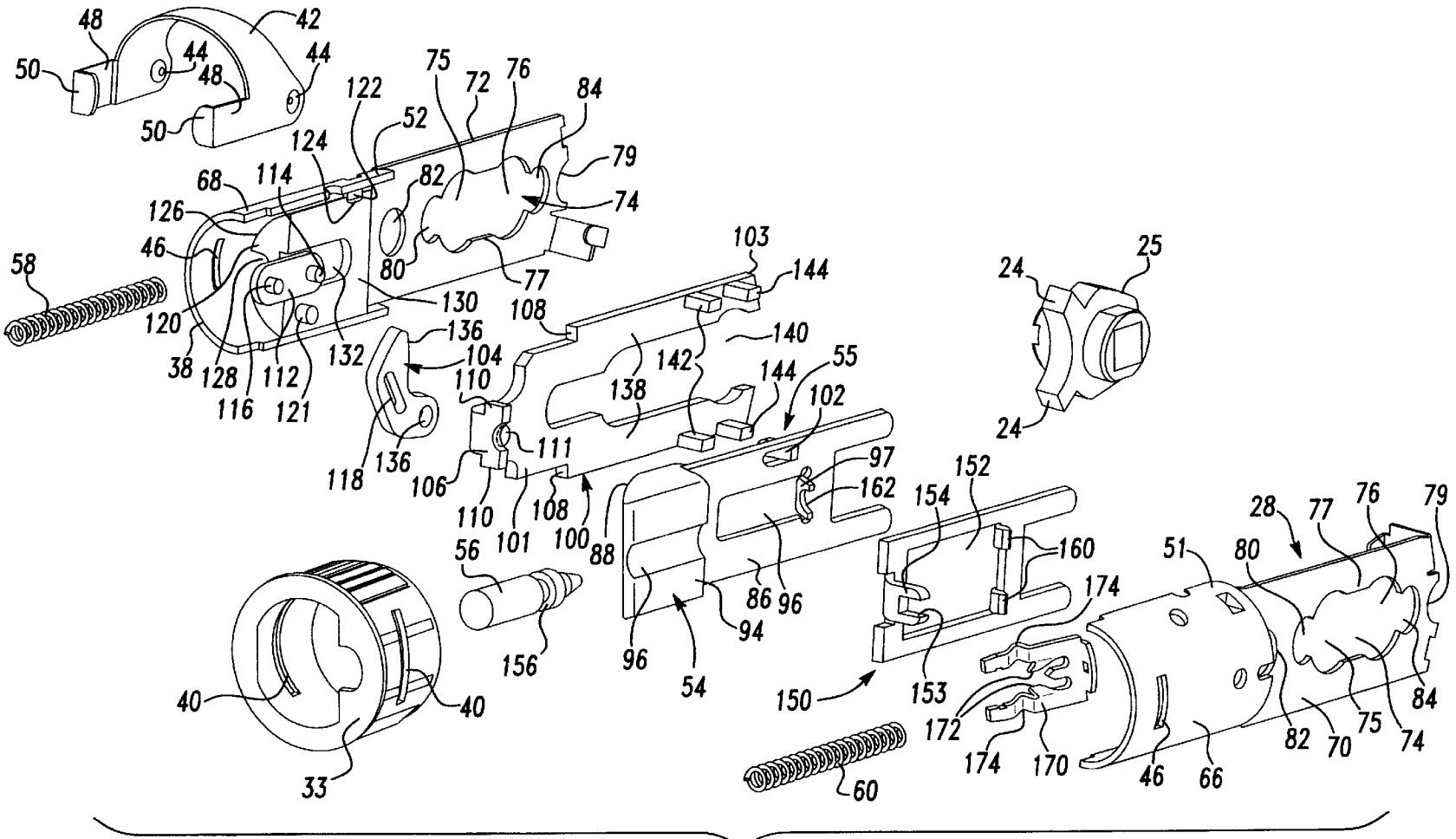
FIG. 5 is an exploded perspective view of the door latch assembly.
Figure 6:
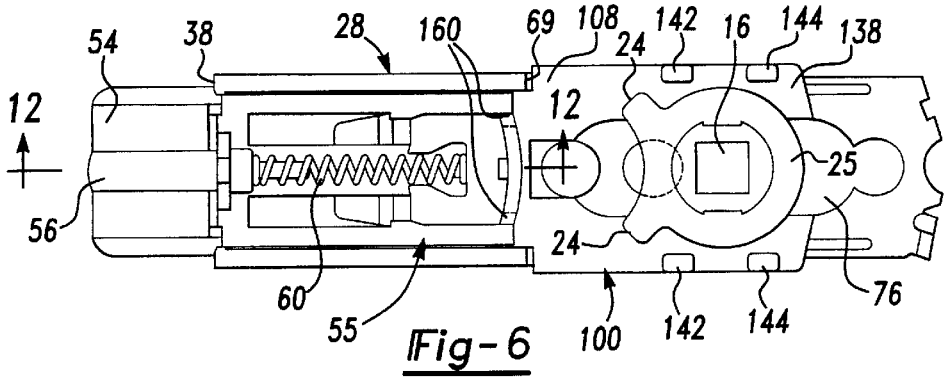
FIG. 6 is a side elevation of the latch assembly with one of the latch housing halves separated from the other to illustrate the latch bolt in an extended position and the actuating cam in the front backset position.
Figure 7:
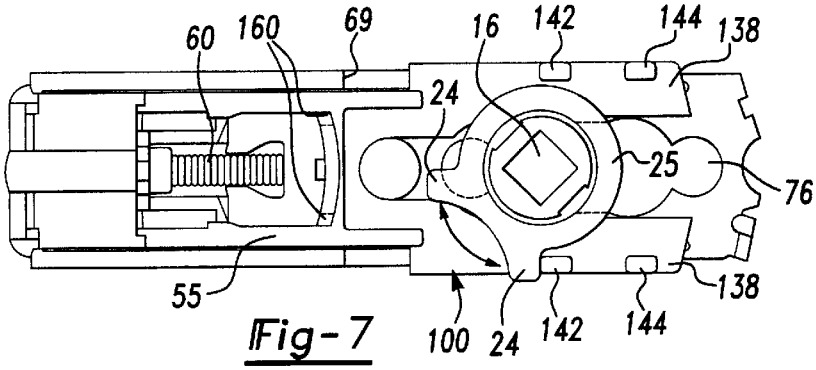
FIG. 7 is a view similar to FIG. 6 except that the actuating cam is rotated 45° to move the latch bolt to a fully retracted position.
Figure 8:
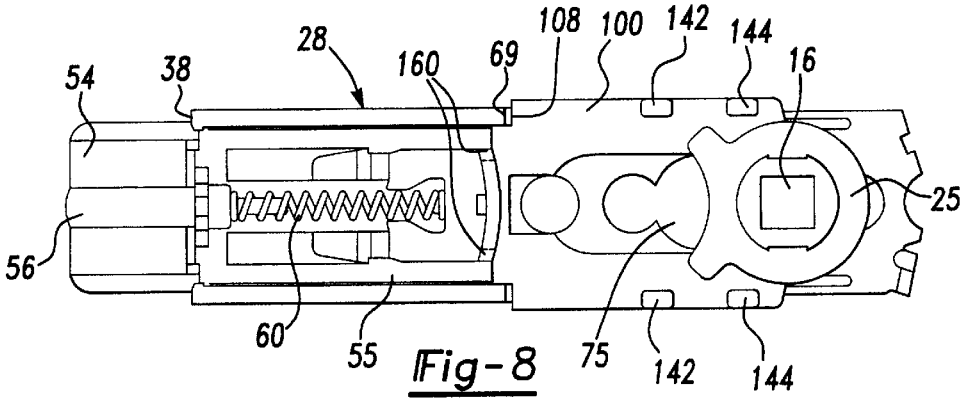
FIG. 8 is a view similar to FIG. 6 except that the actuating cam is in the rear backset position.
Figure 9:
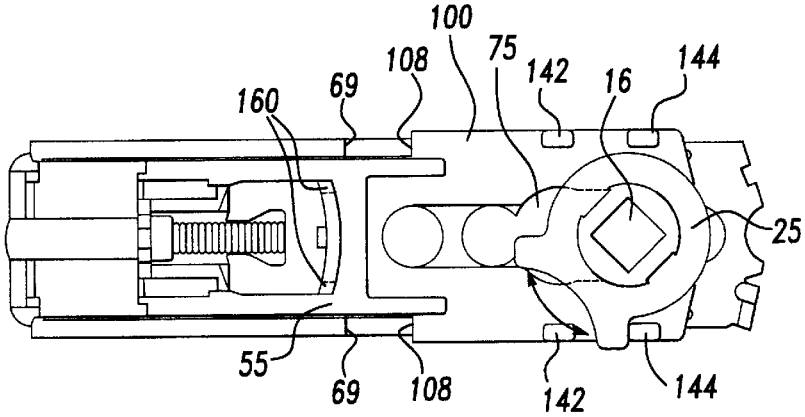
FIG. 9 is a view similar to FIG. 7 except that the actuating cam is in the rear backset position.

Referring now to FIGS. 2 and 5, the latch housing 28 includes a pair of housing halves 51 and 52 that are matingly assembled. The latch housing 28 includes open end 38 through which latch bolt head 54 of latch bolt 55 can extend. In addition a deadbolt element 56 also extends from open end 38. The latch bolt 55 is biased by spring 58 and deadbolt 56 is biased by spring 60 to the extended or latching position as shown in FIGS. 6 and 8. Rotation of the handle 14 and operating cam 25 about an arc of 45° fully retracts the bolt 54 and deadbolt 56 as illustrated in FIGS. 7 and 9 against the bias of springs 58 and 60.

The mechanism, which provides for full retraction of bolt 54 and deadbolt 56 upon a 45° rotation of the handle, is now described in detail. As best illustrated in FIGS. 2 and 5, the latch housing 28 includes a front portion 62 which is generally tubular and rear portion 64 that is generally box shaped. The box rear portion 64 generally has a rectangular cross section and is open at the top and bottom and formed by two generally flat plates 70 and 72. The front portion is comprised of two semi-cylindrical sections 66 and 68. Preferably plate 70 and cylindrical section 66 are integrally formed into housing half 51 and plate 72 and cylindrical section 68 is integrally formed into half 52.

Each housing half 51 and 52 includes aligned double recess openings 74. The aligned double recess openings 74 control the backset position of the operating cam 25. The double recess openings include a front recess 75 and a rear recess 76 with a constricted passageway 77 therebetween. Additional opening or notches 79 at the rear end of latch housing 28 cooperates with the end notch 80 of opening 74 to form a first set of opening to receive the mounting bolts 18 in the first or rear backset position (shown in solid in FIG. 1) while aperture 82 cooperates with end notch 84 in opening 74 to form a second or front set of openings to receive the mounting bolts 18 in the second backset position (shown in phantom in FIG. 1).

Latch bolt element 55 is reciprocally mounted within the housing 28. The latch bolt element 55 includes a latch bolt head 54 and a generally planar latch bolt tail 86. The latch bolt head 54 includes a generally tapered face 88 to engage a conventional striker plate 90 mounted in a doorframe 92. A substantially flat abutment or latching surface 94 has an elongated groove 96 therein to seat the deadbolt 56. The surface 94 engages the edge 93 of hole 91 in the striker plate 90 when the door is latched.

The latch bolt-tail 86 is preferably disposed at a lateral midsection of bolt head 54. The tail 86 is generally planar and has an H-shape with a substantially rectangular opening 96 intermediate its front and rear ends cooperating with a sliding actuator plate 100 so that the latch bolt element 55 can be pulled to a retracted position. The plate 86 has a laterally extending prong 102, which engages an operating cam lever 104 that is operably interposed between the tail 86 and the actuator slide 100. The hook 106 at the front end of actuator plate 100 fits within opening 96 and abuts the rear end 97 of opening 96 to define an outer bias limit that the spring 58 pushes bolt element 55 outward through end 38. Thus when a face plate is removed from the housing 28, actuator plate 100, by abutting rear end of opening 96, prevents the bolt 54 from springing completely out of the housing 28.

The front hook 106 in sliding actuator 100 has two projections 110 generally hooking about and through the opening 96 in the tail 86. In addition the front portion 101 of actuator 100 is narrower than its rear end 103 thus forming two shoulders 108. The width of the front portion 101 is less than the internal diameter of the tubular front portion 62 of housing 28 to allow the front portion 101 to slideably fit therein. The rear end portion 103 is wider than the internal diameter of the tubular front portion 62 of the latch housing 28 and thus unable to fit within the tubular front portion. Instead, portion 103 has shoulders 108 that abut the rear edge 69 of tubular section 62. Thus shoulders 108 of the sliding actuator thus limit the forward longitudinal movement of the slide 100 forward into the interior of the tubular front portion 62 of the housing 28.

The latch bolt element 55 can retract independently of sliding actuator 100 so that the latch bolt head 54 can shift and retract as it strikes the striker plate 90 without the necessity of the latch cam 25 and operating handle 14 rotating.

Prior art devices had the hook 106 used to retract the tail section 86 and bolt 54, thus providing a one to one correspondence of motion of the sliding actuator 100 and bolt element 55. The cam lever 104 is operably interposed between the sliding actuator 100 and the bolt element 55 as illustrate clearly in FIGS. 10 and 11. The sliding actuator 100 has an aperture 111 that receives a rear protrusion 114 of a sliding link element 112. A front protrusion 116 of the link element 112 is received in a slot 118 in the cam lever 104.

The cam lever 104 has an aperture 136 near one end of the cam lever 104 that is pivotally mounted to a pivot pin 121 on an insert 120. The insert 120 is positioned within the tubular section 68 of housing half 52. The insert is affixed against motion by debossments 122 in the tubular section 68 engaging notches 124 of the insert. The insert has a semicircular outer surface 126 that conforms with the inner diameter of the tubular section 68 and has a longitudinal groove 128 therein to seat the spring 58. The inner surface 130 is flat with a channel 132 that seats the link 112 and constrains its motion to a longitudinal direction.

The distal end 136 of the cam 104 engages the laterally extending prong 102 of the bolt element 55. The front protrusion 116 of link 112 is interposed between the pivot pin 121 and the distal end 136 such that there is a mechanical advantage of the distal end compared to the front protrusion 116 of the link when the cam 102 is pivoted.

Figure 10:
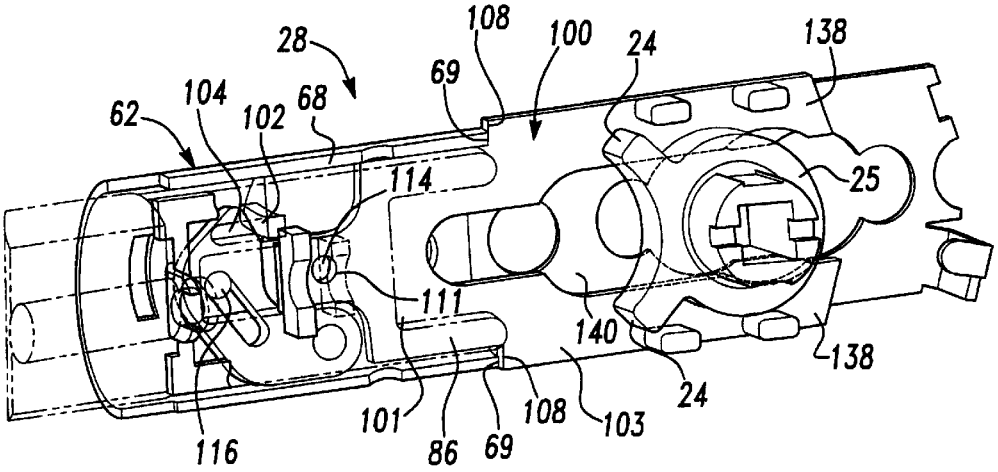
FIG. 10 is a fragmentary view illustrating the internal cam mechanism and the bolt shown in the fully extended position.
Figure 11:
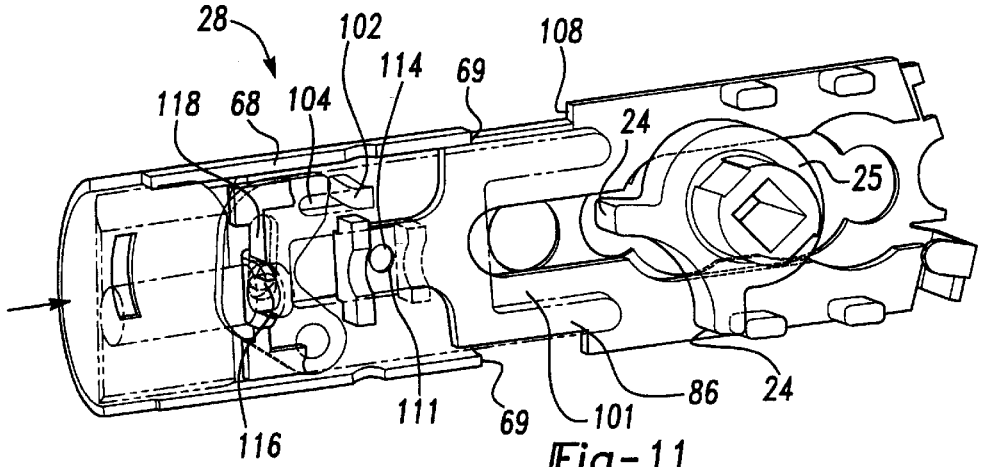
FIG. 11 is a view similar to FIG. 10 with the cam mechanism operated to fully retract the bolt.

Thus when the actuator 100 is retracted a certain amount, as illustrated in FIGS. 6–9, the bolt element 55 retraction is magnified a greater amount. As such, the bolt element 55 changes relative position with respect to the actuator 100 between the extended position as illustrated in FIGS. 6 and 8 and the retracted position as illustrated in FIGS. 7 and 9. The difference in the relative positions is also illustrated in FIGS. 10 and 11.

Referring now to FIGS. 6–9, the rear section of the actuator includes a pair of longitudinally extending spaced apart legs 138 defining an opening 140 therebetween. The legs 138 farther have front flanges 142 and rear flanges 144 which against which the legs 24 of latch cam 25 engage and when turned either clockwise or counterclockwise by rotation of spindle 16. When the cam 25 is set in opening 75, as shown in FIGS. 6 and 7, one of the legs 24 engage a respective flange 142. When the backset is adjusted rearwardly and cam 25 is in aperture 76, as shown in FIGS. 8 and 9, one of the legs 24 engages a respective flange 144.

The engagement of leg 24 with flanges 142 or 144 translates either clockwise or counter clockwise rotational movement of the operating handle 14 and actuating cam 25 into a retracting longitudinal movement of the sliding actuator and also the latch bolt element 55. Because the cam lever 102 accentuates or magnifies the movement of the bolt element 55 with respect to the sliding actuator 100, the rotational movement of about 45° of the handle 14 and cam 25 as shown in FIGS. 7 and 9 is sufficient to fully retract the bolt element 55.

Referring now to FIGS. 2, 12, 13, and 14, the deadbolt 56 is positioned in groove 96 and is seated in a deadlocking slide 150 that is disposed adjacent to and in surface to surface contact with the latch bolt tail 86 on the opposite side from that of the second cam 104. In other words, the bolt-tail 86 is interposed between the cam 104 and the deadbolt slide 150. Deadlocking slide 150 includes an H-shaped plate having a generally rectangular opening 152 therein. A deadlocking bar support arm 154 extends outwardly from the H shaped plate at the front end of opening 152. A notch 153 is formed in the arm 154 to sit in a groove 156 in the deadlock bolt 56. A pair of bent portions or tabs 160 project outward and over the opening 152 adjacent the two rear corners of opening 152 and form operating elements of the deadbolt mechanism. The opening 152 is sized to fit over the upright tab 162 of latch bolt tail 86.

A deadlocking blocker plate 170 is disposed between the deadlocking slide 150 and the latch housing half 51. The details of the deadbolt function are discussed in detail in U.S. Pat. No. 5,257,837 and this patent is incorporated herein by reference.

Figure 12:
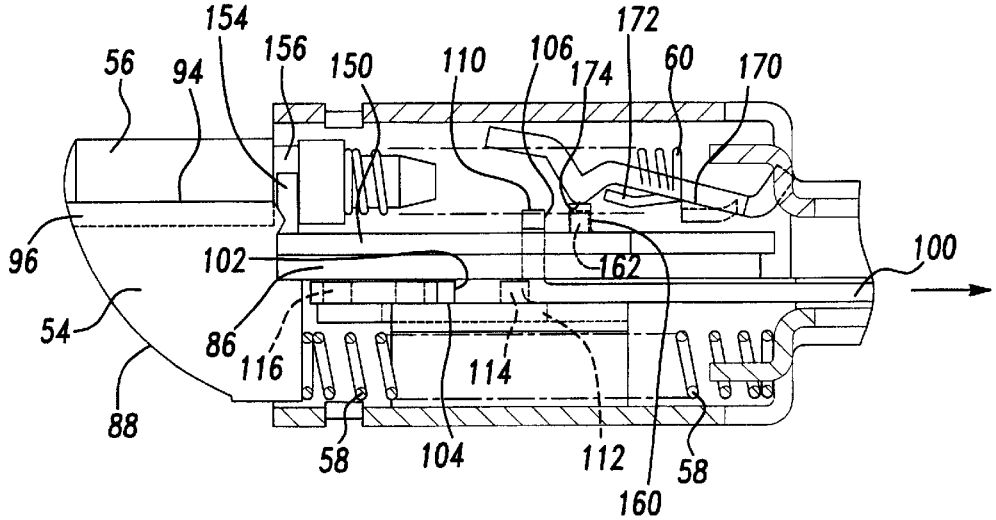
FIG. 12 is a cross-sectional view taken along lines 12—12 shown in FIG. 6.

Briefly, when the deadbolt 56 is extended with bolt head 54 as shown in FIG. 12, it allows bolt 54 to be recessed as when it abuts a striker plate 90 because tabs 160 engage protrusions 174 of blocker plate 170 and laterally moves prongs 172 away from tail 86.

Figure 13:
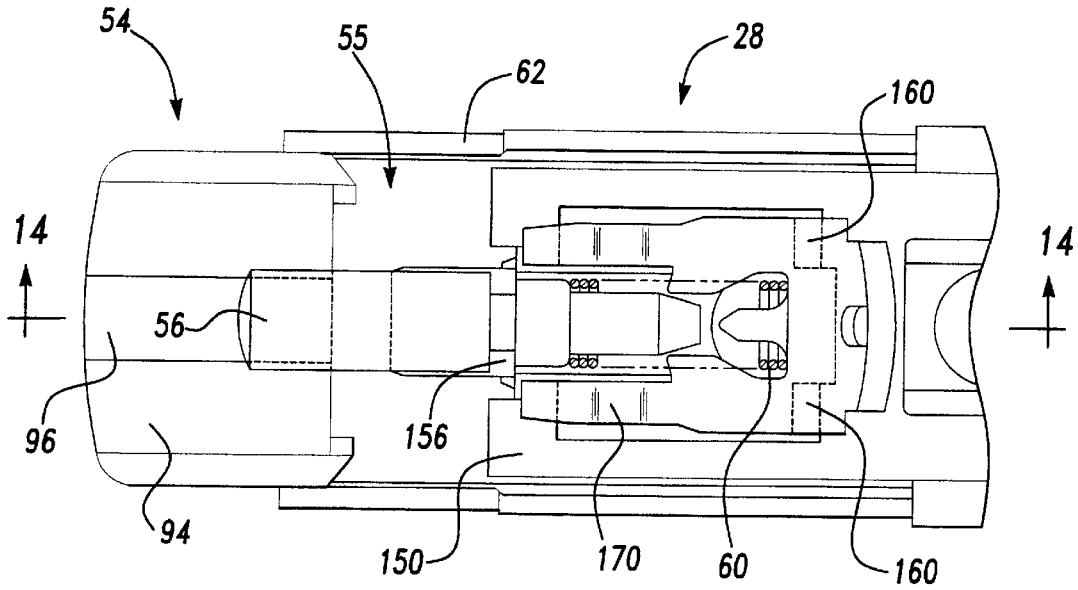
FIG. 13 is a sectional side view of the forward portion of the deadlocking bar partially retracted and the blocker plate in a position to block full retraction motion of the latch bolt.
Figure 14:
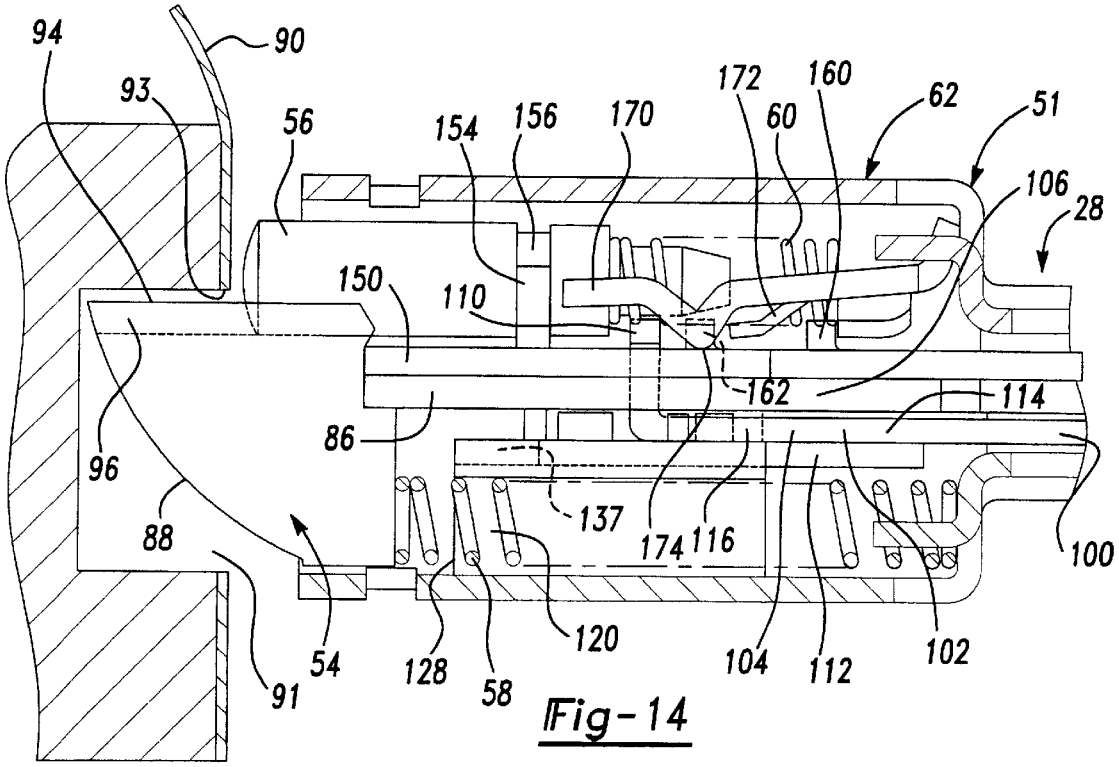
FIG. 14 is a cross-sectional view taken along line 14—14 shown in FIG. 13.

However, when the deadbolt 56 is recessed as in a door as shown in FIGS. 13 and 14, the prong 172 of blocker plate 170 blocks the path of prong 162 on tail 86 and prevents sliding retraction of the bolt head, when the bolt is pushed by a credit card, screw drive or other tampering mechanism.

The door latch bolt can still be operated by handle 14. When the door latch is operated by handle 14, actuator 100 moves and its projections 110 similarly engage the protrusion 174 and laterally moves plate 170 away to move prongs 172 away from tail 86. Thus the bolt 54, when deadbolt is recessed as shown in FIGS. 13 and 14, can only be retracted via operation of the handle 14.

As disclosed in detail in FIGS. 12–14, the function of the deadbolt between its inactive position as shown in FIG. 12 and its retracted and enabling position as shown in FIG. 13 and 14 is not compromised by the installation and function of the cam lever 104 and link 112. The link 112 and cam lever 104 are position on the other side of bolt tail 86 and is remote from the deadbolt 56 and its supporting mechanism and does interfere with the function of the deadbolt 56 and its supportive mechanism.

In this fashion, a latch mechanism can be constructed that includes an accelerating retracting mechanism and a deadbolt mechanism in a compact standard sized housing 28. Backset adjustment can also be incorporated in this housing 28.

Variations and modifications are possible without departing from the scope and spirit of the present invention as defined by the appended claims.

The embodiments in which an exclusive property or privilege is claimed are defined as follows:

1. A door latch assembly comprising:

a latch housing having a latch bolt slideably movable from a latch position to a release position;

a faceplate having an opening sized to receive said latch bolt and a rearwardly extending flange contoured to seat the latch housing therein; and a securement link pivotably connected to one of said housing and flange and having a distal tip bent toward the center axis of said housing to engage at least one slot in the other of said flange and housing when the faceplate is seated on the latch housing to releasably secure the faceplate to the latch housing.

2. A door latch assembly as defined in claim 1 further characterized by:

said link being in the form of a yoke with two aligned pivotable connections to opposite circumferential sides of one of the housing and flange;

said at least one slot being in the form of two opposing slots in the other of the housing and flange; and said yoke having two distal tips that oppose each other and selectively engage the opposing slots.

3. A door latch assembly as defined in claim 2 further characterized by:

a second set of slots on opposing sides of the latch housing or faceplate that is aligned with the opposing slots in the other of the faceplate or latch housing; and the distal tips of the yoke being long enough to extend entirely through the slots in the faceplate and into the slots of the latch housing.

4. A door latch assembly as defined in claim 3 further characterized by:

said slots being arcuate in shape to correspond to the path that the distal tip moves in when the yoke is pivotably moved about its pivotable connection to one of the latch housing and flange.

5. A latch housing for a door latch, said housing characterized by:

a latch bolt slideably movable from a latch position to a release position;

a securement link movably connected to said housing and having a distal tip bent toward the center axis of said housing to be engageable with a slot of a faceplate to releasably secure a faceplate thereto.

6. A latch device characterized by:

a housing defining an interior and an opening at one end thereof having a bolt assembly being biased by a spring to the extended position through said opening and longitudinally slideable in said housing against the force of said spring to a retracted position;

a cam lever having a distal end that is operably connected to said bolt to move said bolt to said retracted position, said cam lever being mounted to said housing to form a fulcrum for said cam lever;

a sliding actuator for reciprocal motion between a first position which corresponds to the extended position of the bolt and a second position which moves the bolt to its retracted position;

a link member operably connecting said sliding actuator to said cam lever at a position closer to said fulcrum connection to said housing than said distal end for allowing motion of said bolt between its extended and retracted positions to be greater than the sliding actuator motion between its first and second positions; and said link being slideably movable and guided in a longitudinal recess in fixed casing in said housing.

7. A latch device as defined in claim 6 further characterized by:

said sliding actuator having a planar section that is laterally disposed adjacent a rearwardly extending plate section of said bolt;

said link being disposed adjacent said planar section of said sliding actuator and said cam lever being generally disposed in the same plane as said planar section of said sliding actuator.

8. A latch device as defined in claim 7 further characterized by:

said link having a first and second protrusion in proximity to a respective end thereof;

said first protrusion received in said and engaging an aperture in said sliding actuator;

said second protrusion received in and engageable in a slot of said cam lever.

9. A latch device as defined in claim 8 further characterized by:

said planar section of said bolt having a prong that laterally extends into the plane of said cam lever for engagement to the distal end of said cam lever.

10. A latch device as defined in claim 6 further characterized by:

a deadbolt disposed on one side of said bolt and having a parallel path of reciprocation;

a deadlocking slide engaged with said deadbolt and adapted to move with said deadbolt laterally disposed adjacent an opposite side of said planar section of said bolt from said sliding actuator, said link and said cam lever; and a blocker member actuated by said deadlocking slide to selectively engage the bolt and block retracting motion of said bolt.

11. A door latch assembly comprising:

a door handle;

a spindle with a distal end mounting said handle thereon;

a latch housing having a latch bolt slideably movable from a latch position to a release position with said bolt operably connected to said spindles such that operation of said handle slideably moves said bolt;

a faceplate having an opening sized to receive said latch bolt and a rearwardly extending flange contoured to seat the latch housing therein; and a securement link moveably connected to one of said housing and flange and having a distal tip bent toward the center axis of said housing to engage at least one slot in the other of said flange and housing when the faceplate is seated on the latch housing to releasably secure the faceplate to the latch housing.

12. A door latch assembly as defined in claim 11 further characterized by:

said link being in the form of a yoke with two aligned pivotable connections to opposite circumferential sides of one of the housing and flange;

said at least one slot being in the form of two opposing slots in the other of the housing and flange; and said yoke having two distal tips that oppose each other and selectively engage the opposing slots.

13. A door latch assembly as defined in claim 12 further characterized by:

a second set of slots on opposing sides of the latch housing or faceplate that is aligned with the opposing slots in the other of the faceplate or latch housing; and the distal tips of the yoke being long enough to extend entirely through the slots in the faceplate and into the slots of the latch housing.

14. A door latch assembly as defined in claim 13 further characterized by:

said slots being arcuate in shape to correspond to the path that the distal tip moves in when the yoke is pivotably moved about its pivotable connection to one of the latch housing and flange.

15. A latch device characterized by:

a door handle;

a spindle with a distal end mounting said handle;

a housing defining an interior and an opening at one end thereof having a bolt assembly being biased by a spring to an extended position through said opening and longitudinally slideable in said housing against a force of said spring to a retracted position;

said bolt operably connected to said spindle such that operation of said handle operably moves said bolt;

a cam lever having a distal end that is operably connected to said bolt to move said bolt to said retracted position, said cam lever being pivotably mounted to said housing;

a sliding actuator for reciprocal motion between a first position which corresponds to the extended position of the bolt and a second position which moves the bolt to its retracted position;

a link member operably connecting said sliding actuator to said cam lever at a position closer to said pivotable connection to said housing than the distance of said distal end to the pivotal connection for allowing motion of said bolt between its extended and retracted positions to be greater than the sliding actuator motion between its first and second positions; and said link being slideably movable and guided in a longitudinal recess in fixed casing in said housing.

16. A latch device as defined in claim 15 further characterized by:

said sliding actuator having a planar section that is laterally disposed adjacent a rearwardly extending plate section of said bolt; and said link being disposed adjacent said planar section of said sliding actuator and said cam lever being generally disposed in the same plane as said planar section of said sliding actuator.

17. A latch device as defined in claim 16 further characterized by:

said link having a first and second protrusion in proximity to a respective end thereof;

said first protrusion received in said and engaging an aperture in said sliding actuator;

said second protrusion received in and engageable in a slot of said cam lever; and said link being slideably movable and guided in a longitudinal recess in fixed casing in said housing.

* * * * *